United States Patent [19]

Bishop

[11] Patent Number: 4,644,983

[45] Date of Patent: Feb. 24, 1987

[54] SPILL REDUCING SYSTEM

[75] Inventor: Stephen R. Bishop, Bristol, United Kingdom

[73] Assignee: Texaco Limited, London, England

[21] Appl. No.: 714,134

[22] Filed: Mar. 20, 1985

[51] Int. Cl.[4] ..... B65B 3/04; B67D 5/00

[52] U.S. Cl. ..... 141/387; 141/311 A; 141/86; 141/231; 222/109; 137/615; 137/312; 137/313

[58] Field of Search ..... 141/85, 86–88, 141/89, 90, 106, 115, 121, 231–233, 363, 364, 98, 331–333, 311, 387–389; 137/615, 312–314, 237; 222/108, 109

[56] References Cited

U.S. PATENT DOCUMENTS

| | | | |
|---|---|---|---|
| 296,531 | 4/1884 | Cole | 222/109 |
| 829,609 | 8/1906 | Steinke | 137/313 |
| 874,246 | 12/1907 | Rose | 137/313 |
| 1,598,768 | 9/1926 | Frantz | 222/109 |
| 1,690,735 | 11/1928 | Lathrop | 141/364 X |
| 1,851,338 | 3/1932 | Wemple | 222/109 |
| 2,616,095 | 11/1952 | Stuckey | 222/109 X |
| 2,764,317 | 9/1956 | Lisciani | 222/109 |
| 2,939,593 | 6/1960 | Kelley | 141/106 |
| 3,114,392 | 12/1963 | Harper | 141/387 X |
| 3,300,093 | 11/1967 | Keves et al. | 222/109 |
| 3,712,330 | 1/1973 | Davis | 137/312 |
| 4,109,688 | 8/1978 | Jameson | 141/387 |
| 4,341,242 | 7/1982 | Hermanson | 137/615 |

*Primary Examiner*—Stephen Marcus
*Assistant Examiner*—Ernest G. Cusick
*Attorney, Agent, or Firm*—Robert A. Kulason; James J. O'Loughlin

[57] ABSTRACT

Apparatus for reducing spillage in connection with a liquid product loading dock. It has a double funnel arrangement with one funnel attached to the first swivel of plural fill pipes which have swivel joints to permit placing the free end into a mobile tank to be filled. That funnel moves with the fill pipes through about one hundred eighty degrees of freedom, and has structure for receiving the free end of the fill pipes after a filling operation. Consequently, run off of product from the fill pipes goes into the funnel. There is a conduit connected to the funnel outlet that moves with it and extends into a second funnel that is coaxial with the product delivery pipe. From there, the run off is returned to a collection tank.

6 Claims, 5 Drawing Figures

SPILL REDUCING SYSTEM

BACKGROUND OF THE INVENTION

1. Field of the Invention

This invention concerns an apparatus for reducing spillage, in general. More specifically, it concerns a system for returning run off fluid from product delivery structures that employ elongated fill pipes.

2. Description of the Known Related Art

There is a U.S. patent to H. D. Smith, U.S. Pat. No. 1,717,944 issued June 18, 1929 which discloses dispensing apparatus. However, that patent disclosure is not relevant to the type of structures employed which is relevant to this invention.

Also, there is a U.S. Pat. No. 2,957,489 to W. C. Fisher, issued Oct. 25, 1960 which concerns an anti-drip-trap for a loading spout. That patent has a special trap element located near the last fill pipe of its delivery system. The trap includes a siphon associated with the trap chamber so that the product is cleared from the trap by the siphoning action. Also, the capacity of the trap's interior is sufficient for catching drip type run off which may reach that chamber after a filling procedure is finished. The system of that patent is not relevant to a loading dock structure which combines a double funnel system according to the applicant's invention.

SUMMARY OF THE INVENTION

Briefly, the invention concerns a spill reducing system for a loading dock employing elongated fill pipes with swivel joints for delivering a fluid product from a stationary supply container through a fixed upright conduit on said stationary container, to a mobile container. It comprises first funnel means attached to said stationary container for returning drainings from said fill pipes, and second funnel means attached to said fill pipes for directing drainings into said first funnel means and thence to a drain receptacle.

Once more briefly, the invention concerns a spill reducing system for a loading dock employing elongated fill pipes with swivel joints for delivering a fluid product from a stationary supply container through a fixed upright supply conduit on said stationary container, to a mobile container. It comprises a first funnel coaxial with said fixed upright conduit having a drain therefrom to a collection tank, and a second funnel attached to said fill pipes for swivelling around said fixed upright conduit at least about one hundred eighty degrees. It also comprises a chute associated with said second funnel for receiving the free end of said fill pipes, and a funnel conduit for draining said second funnel. The said funnel conduit extends down beside said upright supply conduit and reaches inside said first funnel.

Again briefly, the invention is in combination with a stationary liquid supply container having an upright conduit for dispensing said liquid, and a plurality of elongated fill pipes having a plurality of swivel joints for allowing universal manipulation of a free end thereof to permit placement of said free end into a mobile container. It is also in combination with a system for reducing spillage of said liquid due to run off from said fill pipes, and it comprises first funnel means for receiving said free end after filing said mobile container. It also comprises means for attaching said first funnel means to said fill pipes adjacent to said upright conduit for swivel movement with said pipes. It also comprises second funnel means for receiving said run off liquid from said first funnel means, and means for collecting said run off liquid from said second funnel means.

Once more briefly, the invention is in combination with a stationary liquid container having an articulated fill pipe assembly defined by an upright conduit for dispensing said liquid, and a plurality of elongated fill pipes having a plurality of swivel joints for allowing universal manipulation of a free end to permit placement of said free end into a mobile container. It is also in combination with a system for reducing spillage of said liquid due to run off from said fill pipes, and it comprises first funnel means for receiving said free end after filling said mobile container and having a chute pivotally attached to said funnel for conforming said chute to the angle of said fill pipe free end. The said first funnel means also comprises a conduit for carrying said run off from the funnel into said second funnel means, and said last named conduit extends down beside said upright conduit. It also comprises second funnel means for receiving run off liquid from said first funnel means. The said second funnel means comprises a funnel coaxial with said upright conduit, and said first funnel means conduit extends into said second coaxial funnel below the upper edge thereof.

The term "swivel" and "swiveling" as used herein refers to the type of movement of which the fill pipe assembly is capable with respect to the stationary upright conduit which supports said assembly. The terminology further relates to the relative movement experienced between the respective fill pipe assembly segments as a result of the various pipe connections which communicate said segments.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

This invention is particularly applicable to product loading operations wherein fluid product is loaded from stationary tank or tanks into a mobile tank adjacent to the dock. Thus, the loading operation involves a sizeable loading dock that includes one or more fixed upright conduits extending above the surface of the dock. Through such conduit, the product is delivered via a plurality of elongated fill pipes with swivel joints. The fill pipes are arranged so that the product may be introduced into the mobile tank from the free end of the fill pipes after the free end has been located inside the mobile receptacle. In order to accomplish that, there are full swivel joints and elbows so as to permit universal action in the loading process.

It has been found heretofore that particularly in regard to denser products, such as middle distillates, the drain down time of the loading arm can take as long as several minutes. Consequently, during such period of time (especially if there are windy conditions) the associated area of the loading dock and a tank wagon be filled, can be saturated with product which of course increases the possibility of injury to personnel and/or fire risk.

It will be understood that this type of loading operation involves a stationary supply of liquid product in a stationary tank (not shown) which is located at the loading dock. There are a plurality of fixed upright conduits (only one shown) for delivering the product to a mobile container such as a tank truck or the like. The loading operation involves substantial quantities and the equipment for carrying out such delivery includes plural elongated fill pipes which, together constitute the fill pipe assembly, with elbows and swivel joints so that the mobile container or tank may be located at any near by location adjacent to the dock. Because of the size and weight of the fill pipe assembly or fill pipes, the arrangement includes a heavy duty spring biased support for the fill pipes. It is located at the top of the stationary supply conduit and its function is to counteract the weight of the fill pipes so as to permit them to be swung back out of the way following a delivery. This involves an "at rest position" for the fill pipes which leaves the free end of the latter folded back to a position adjacent the top of the fixed delivery conduit and at an upward angle. Consequently any product which adheres to the walls of the pipe will drain out. However, by employing a double funnel system according to this invention, in conjunction with the loading conduit structure described, the drain down fluid or residual fluid which drains from the fill pipe asembly after a filling operation has terminated, is not spilled but rather is returned down to a collection tank. The latter can be the main product tank itself if desired.

Figure 5:
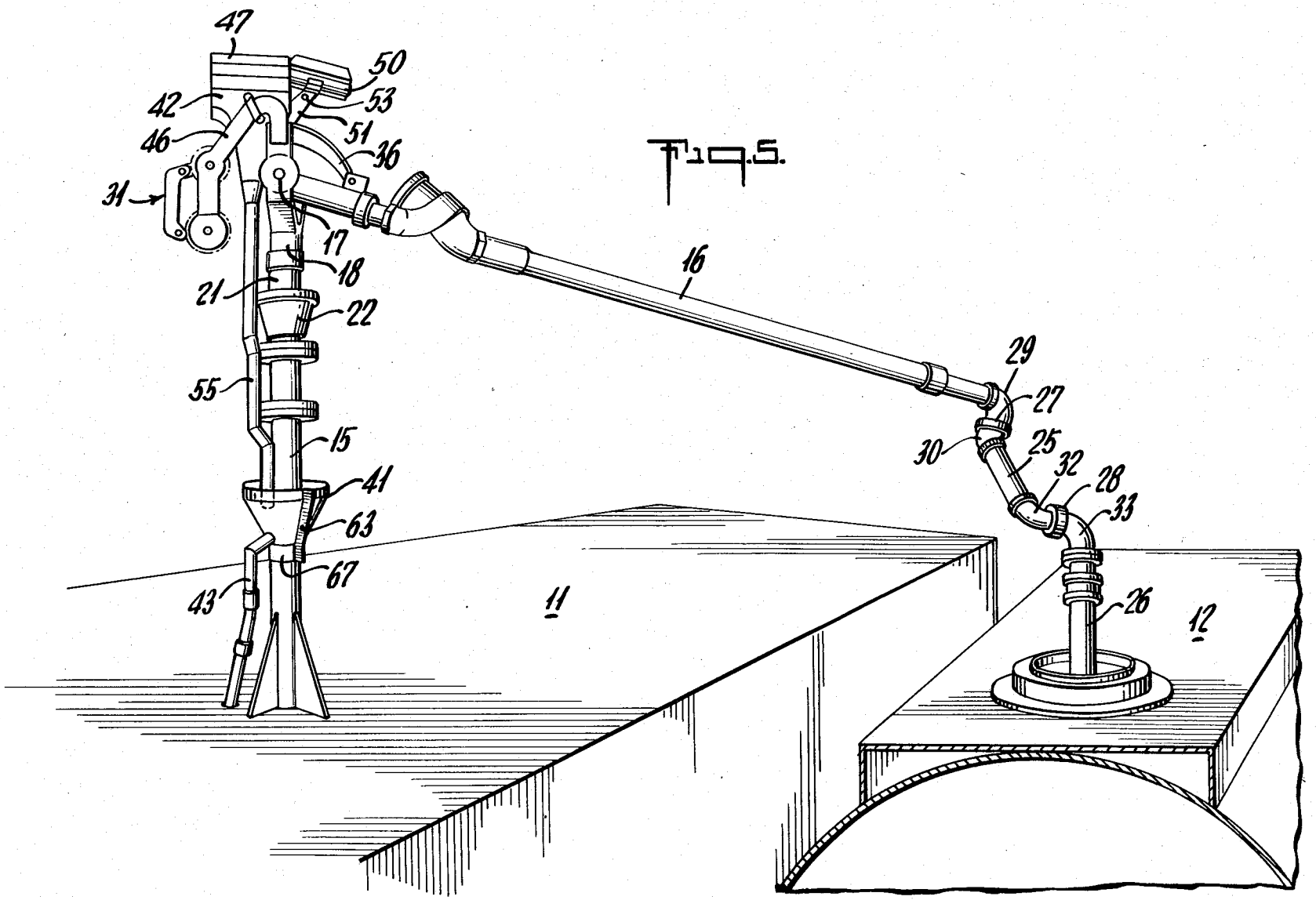
FIG. 5 is a perspective view showing a loading dock with a fixed upright conduit thereon, plus a mobile container which is in the form of a tank wagon being filled.

Referring to the figures of drawing, FIG. 5 schematically illustrates a loading dock 11, with a tank wagon 12 located along side. The loading dock 11 has a fixed upright conduit 15 mounted thereon for delivering liquid product from a stationary supply container (not shown) which is located at the dock 11 underneath the upper surface thereof. The product is delivered through the conduit 15, and there are a plurality of elongated fill pipes including a pipe 16 connected to the top of the conduit 15.

It will be observed that the pipe 16 is connected to the top of the conduit 15 in such a manner as to permit it to be raised and lowered about a pivotal axis 17 that is formed at the ends of a yolk 18. The yolk 18 is attached to a short pipe 21 and both are supported for full swivel rotation about the axis of conduit 15. This is accomplished by a thrust bearing 22.

There are additional fill pipes 25 and 26 with swivel joints 27 and 28 that are connected between elbows 29, 30 and 32, 33 respectively. In this manner, the fill pipes 16, 25 and 26 have swivel joints 27 and 28 at right angles to one another interconnecting the fill pipe so that there is substantially universal freedom of positioning for the pipe 26. Fill pipe 26 is the extreme fill pipe which has a free end 24 to discharge the product into the tank 12.

There is a spring bias type counterweight arrangement 31 that is coupled to the hinged end of the fill pipe 16, in order to apply a lifting force about the pivotal axis 17 against the weight of fill pipe 16, 25 and 26. It will be appreciated that there is an arcuate arm 36 which is pivoted at both ends and which acts to adjust the tension on the springs of the unit 31 as the pipe 16 is raised and lowered.

The spill reducing system according to this invention is mounted on the upright conduit 15 which extends up from the loading dock 11. The system employs two funnels 41 and 42. The lower funnel 41 is mounted coaxially around the conduit 15, and it has a piping connection 43 from the bottom thereof to carry any fluids from the funnel 41 down to a collection tank (not shown), or back into the product tank (not shown) to which the fixed conduit 15 connects, if desired. The upper funnel 42 is strapped onto an arm 46 that is integrally attached to the yolk 18. Consequently, the funnel 42 moves with the fill pipe 16 whenever the latter is rotatably adjusted about the vertical axis of the conduit 15. This is achieved by rotating the entire filler pipe assembly which is operably supported on the thrust bearing 22. The funnel 42 has a rectangular shaped top structure 47 and there is a chute 50 that is attached to a flange 51 that is welded on the funnel 42 for pivotal movement of the chute 50 about a pin 53.

The bottom of upper funnel 42 has a pipe 55 that extends down beside the fixed conduit 15. It reaches into the inside of the lower funnel 41 and extends beneath the top edge thereof. It may be noted that the funnel 42 because it is strapped onto the yolk structure that connects fill pipe 16 with the fixed upright conduit 15, may rotate through as much as approximately one hundred eighty degrees of swing of the fill pipe 16. As that rotation takes place the drain pipe 55 will swing around the outside of the fixed conduit 15. However, during such movement the pipe 55 will continue to make a fluid path connecting the run off product from the funnel 42 down through the pipe 55 into the funnel 41. Then from the funnel 44 it will flow on down through piping 43 from the bottom of funnel 41 to the collection tank below.

FIGS. 1–4 illustrate the elements in their positions following a filling operation, when the fill pipe has been raised into and at rest position. At that time the run off product flows back and is collected so as to avoid the spillage which otherwise would occur. The fill pipe 26 is raised with the other fill pipes including 16 and 25 (see FIG. 5), and a free end or nozzle 60 on pipe 26 is placed so as to rest on the chute 50 which may pivot about its pivot pin 53 to accommodate the resting position (see FIGS. 1 and 2). This places the nozzle 60 inside of the funnel 42 with its rectangular top portion 47, so that the run off product will be discharged into the funnel.

It may be noted that the lower funnel 41 which is attached in a coaxial position around the fixed conduit 15 may be mounted in any convenient manner. The mounting that is illustrated employs a pair of contour flanges 63 and 64 which are welded to the funnel 41 with a band 67 at the bottom for support thereof.

OPERATION

Figure 1:
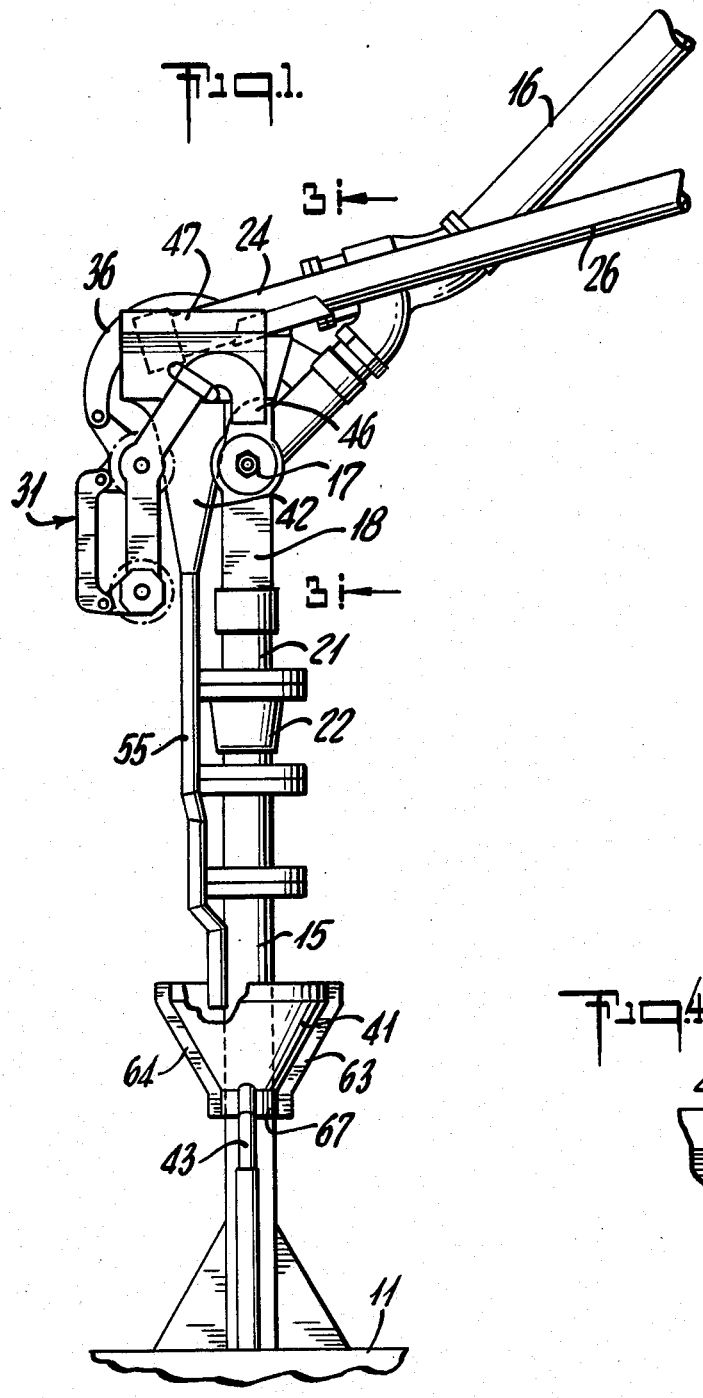
FIG. 1 is a side elevation showing a fixed upright conduit with a double funnel system attached thereto, in accordance with the invention.
Figure 3:
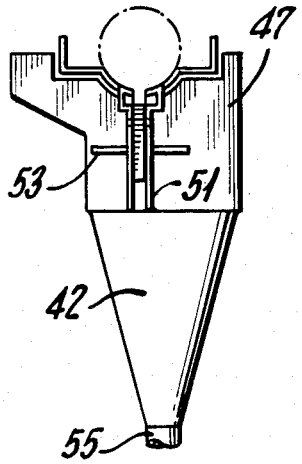
FIG. 3 is a side elevation of the upper funnel alone, taken along the lines 3—3 in FIG. 1 and looking in the direction of the arrows.
Figure 4:
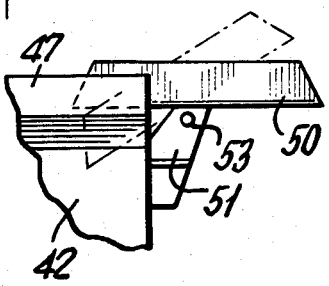
FIG. 4 is a fragmentary side elevation of the funnel taken at right angles to FIG. 3 along the lines 4—4 on FIG. 2 and looking in the direction of the arrows.
Figure 2:
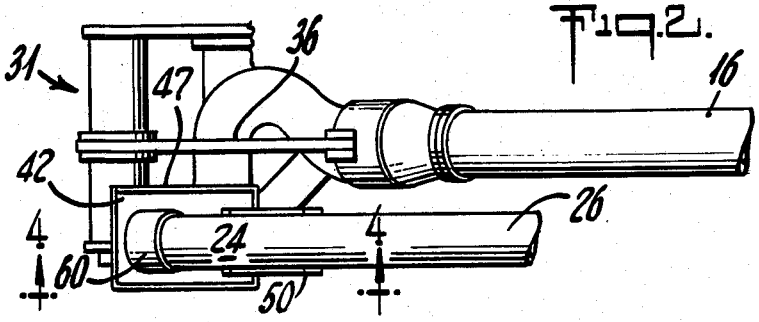
FIG. 2 is a partial plan view of the elements illustrated in FIG. 1 looking down from the top.

It will be appreciated that the double funnel system according to this system is applicable to a loading operation where there is an upright stationary conduit through which product is pumped for delivery from the top via a plurality of relatively long fill pipes. The fill pipes are joined together with plural swivel joints so that the loading operation may be carried out with manipulation of the fill pipes by hand. Such manipulation includes inserting the end pipe 26 into the container, such as the tank wagon 12, for filling it. Thus, FIG. 5 shows the elements in position for filling the tank wagon 12 from a supply of liquid product, which is located in the loading dock 11 and connected to the conduit 15 through which product is pumped. When the tank wagon 12 has been filled, the pumping operation will be stopped and an operator will manually raise the fill pipe 26 by manipulating fill pipes 25 and 26 along with the pipe 16. Such manipulation is carried out so as to raise fill pipe 26 out of the tank wagon 12. Then, by swivelling and swinging the fill pipes about their swivel joints, the free end of pipe 26 (which has the nozzle 60 thereon) is placed up onto the chute 50 with the nozzle 60 resting inside the top edges 47 of the upper funnel 42. After that, the operator will let go of the fill pipes and the counterweight spring bias unit 31 will act so as to raise the group of fill pipes 16, 25 and 26 up to their upper most position, which is illustrated in FIG. 1. As that resting position is being accomplished, and as soon as the fill pipe 26 is raised to an upwardly inclined position, the product remaining in the fill pipe 26 will drain out into the upper funnel 42. The run off product then goes down through the pipe 55 from which it drains into the lower funnel 41. From there it continues down through pipe 43 which connects to a collection tank, or back into the product supply tank if desired, as previously described.

It will be noted that during a filling procedure the end fill pipe 26 extends down into the tank 12, and the horizontal angular position of the fill pipe 16 is such as to accommodate the location of fill pipe 26 for extending into the tank 12 which is being filled. Then following removal of the fill pipe 26 from the tank wagon 12, the pipes are folded back so as to put the open end of pipe 26 onto the chute 50. Thereafter, the fill pipes will be swung horizontally around out of the way so that the full tank wagon may be moved away from the loading dock 11.

The foregoing horizontal swinging of the fill pipes carries the upper funnel 42 and its drain pipe 55 around the outside of the stationary conduit 15. However, that movement does not create any difficulty with the drainage connection from the pipe 55 into the lower funnel 41. This is because the lower end of pipe 55 extends inside the top of funnel 41 and beneath the upper surface thereof. Consequently the draining of the run off liquid is always within the funnel 41 and any spillage is eliminated.

It will be appreciated that a system according to this invention provides for allowing the run off liquid (which may take substantial amount of time) to be confined without spillage. In this manner it may be returned for later delivery or it may be accumulated for other disposition. Consequently, product is not spilled around on the loading dock surface which would tend to create hazard and danger.

While the invention has been described above in considerable detail in accordance with the applicable statutes, this is not to be taken as in any way limiting the invention but merely as being descriptive thereof.

I claim:

1. A spill reducing system for a loading dock having a stationary container which holds a supply of liquid to be transferred to a mobile container (42), which stationary container is fixedly communicated to an upright conduit (15), at least one elongated articulated fill pipe assembly sealably engaging said upright conduit (15) at a rotatable seal joint (22), said fill pipe assembly including a plurality of fill pipe segments (21, 16, 26) which are interconnected into a continuous conduit by swivel joints therebetween, fill pipe segment (26) having a discharge end which is adapted to removably register in a filler port of the mobile container during a liquid transfer operation to the latter, said spill reduction system including:

a first funnel (41) depending from said upright conduit (15), a second funnel (42) depending from said fill pipe assembly and being horizontally movable in response to rotative movement of the fill pipe assembly with respect to said upright conduit (15), drain conduit means (43, 55) communicating the respective first and second funnels with a collection tank, and a chute (50) depending from said fill pipe assembly including, a pipe support member positioned to supportably engage the end of said remote fill pipe segment (26) to align the discharge end thereof with said second funnel (42) when the remote pipe segment (26) is disengaged from said mobile container filler port, whereby residual liquid in said fill pipe assembly will drain from the remote pipe segment (26), into said second funnel (42).

2. In the apparatus as defined in claim 1, wherein said drain conduit means (55) includes an upper portion which depends from second funnel (42), and which communicates with the first funnel (41), and is rotated about said upright conduit (15) when the fill pipe assembly is adjusted in conjunction with a liquid transfer operation.

3. In the apparatus as defined in claim 2, wherein the drain conduit means (55) is rotated about said upright conduit (15) in response to a rotational movement of the fill pipe assembly with respect to said upright conduit (15).

4. In the apparatus as defined in claim 1, wherein said chute (50) is pivotally engaged with said fill pipe assembly to allow pivotal movement of the pipe support member in a generally vertical plane.

5. In the apparatus as defined in claim 1, wherein said first funnel is fixed to, and disposed coaxially of said upright conduit (15).

6. In the apparatus as defined in claim 1, wherein said fill pipe assembly includes a first pipe segment (21) communicated with said upright conduit (15), and said second funnel (42) depends from said first pipe segment.

* * * * *